US011784415B2

(12) United States Patent
Mora Plaza et al.

(10) Patent No.: US 11,784,415 B2
(45) Date of Patent: Oct. 10, 2023

(54) DEPLOYABLE ASSEMBLY FOR ANTENNAS

(71) Applicant: AIRBUS DEFENCE AND SPACE S.A., Madrid (ES)

(72) Inventors: José Luis Mora Plaza, Madrid (ES); Fernando José Cespedosa Castán, Madrid (ES)

(73) Assignee: AIRBUS DEFENCE AND SPACE S.A., Madrid (ES)

( * ) Notice: Subject to any disclaimer, the term of this patent is extended or adjusted under 35 U.S.C. 154(b) by 0 days.

(21) Appl. No.: 17/762,673

(22) PCT Filed: Sep. 24, 2019

(86) PCT No.: PCT/ES2019/070635
§ 371 (c)(1),
(2) Date: Mar. 22, 2022

(87) PCT Pub. No.: WO2021/058838
PCT Pub. Date: Apr. 1, 2021

(65) Prior Publication Data

US 2022/0359992 A1 Nov. 10, 2022

(51) Int. Cl.
*H01Q 15/16* (2006.01)
*H01Q 1/12* (2006.01)
*H01Q 1/28* (2006.01)

(52) U.S. Cl.
CPC ..... *H01Q 15/161* (2013.01); *H01Q 1/1235* (2013.01); *H01Q 1/288* (2013.01)

(58) Field of Classification Search
CPC ..... H01Q 1/08; H01Q 1/1235; H01Q 1/288; H01Q 1/36; H01Q 15/161
See application file for complete search history.

(56) References Cited

U.S. PATENT DOCUMENTS 3,617,113 A 11/1971 Hoyer
3,631,505 A * 12/1971 Carman ..... H01Q 15/161 343/915

(Continued)

FOREIGN PATENT DOCUMENTS

CN 107248620 A 10/2017
EP 2482378 A1 8/2012

(Continued)

OTHER PUBLICATIONS

International Search Report for PCT/ES2019/070635 (dated Jun. 9, 2020).

*Primary Examiner* — Jason Crawford
(74) *Attorney, Agent, or Firm* — Merchant & Gould P.C.

(57) ABSTRACT

A deployable assembly for antennae includes a structure having a reflective surface and n pairs of segments, each pair of segments corresponding to one side of a deployed polygonal shape. N hinge joints are between the two segments of a side. N hinged angular links are between every two adjacent sides. The structure is changeable from a stowed substantially cylindrical shape into a deployed substantially planar polygonal shape with n sides. A deployable boom is between two segments. The boom lays stowed between the two segments before deployment and ends in a feeder electromagnetically feeding the antenna and includes a clamping element for keeping the structure closed when stowed. The feeder acts as structural support element when stowed and electromagnetic feeder for the antenna when deployed. A cable network shapes the reflective surface, with corresponding cables held by tensor elements protruding from the back of the segments.

8 Claims, 4 Drawing Sheets

(56) References Cited

U.S. PATENT DOCUMENTS 4,030,102 A * 6/1977 Kaplan ..... H01Q 15/161 244/172.6
4,845,511 A * 7/1989 Grayson ..... F24S 23/31 343/915
5,104,211 A * 4/1992 Schumacher ..... F24S 23/81 343/915
5,146,719 A * 9/1992 Saito ..... E04B 1/3544 52/80.1
5,635,946 A * 6/1997 Francis ..... H01Q 15/161 343/915
5,864,324 A * 1/1999 Acker ..... H01Q 15/161 343/915
5,963,182 A * 10/1999 Bassily ..... H01Q 1/288 343/915
6,229,501 B1 * 5/2001 Roth ..... H01Q 1/288 343/915
6,340,956 B1 * 1/2002 Bowen ..... H01Q 15/161 343/915
9,608,333 B1 * 3/2017 Toledo ..... H01Q 1/10
10,418,712 B1 * 9/2019 Henderson ..... H01Q 19/134
10,707,552 B2 * 7/2020 Harless ..... H01Q 1/288
10,797,400 B1 * 10/2020 Henderson ..... H01Q 15/147
2009/0057492 A1 * 3/2009 Harris ..... B64G 1/44 244/171.1
2011/0187627 A1 * 8/2011 Palmer ..... H01Q 15/161 343/915
2013/0141307 A1 * 6/2013 Nurnberger ..... H01Q 1/288 343/912
2015/0303582 A1 * 10/2015 Meschini ..... B64G 1/222 343/840
2018/0254547 A1 * 9/2018 Cwik ..... H01Q 3/06
2018/0370657 A1 * 12/2018 Wu ..... B64G 1/242
2019/0214737 A1 * 7/2019 Dominocielo ..... H01Q 15/161
2020/0028274 A1 * 1/2020 Henderson ..... H01Q 15/16
2020/0153077 A1 * 5/2020 Taylor ..... H01Q 15/168
2021/0088064 A1 * 3/2021 Taylor ..... H01Q 1/103
2022/0359992 A1 * 11/2022 Plaza Mora ..... H01Q 15/161

FOREIGN PATENT DOCUMENTS

EP 2768077 A1 8/2014
EP 3480885 A1 5/2019
JP 6556583 B2 8/2019
WO 2009/153454 A2 12/2009
WO 2013/135298 A1 9/2013

* cited by examiner

DEPLOYABLE ASSEMBLY FOR ANTENNAS

This application is a National Stage of PCT/ES2019/070635, filed Sep. 24, 2019, which application is incorporated herein by reference. To the extent appropriate, a claim of priority is made to the above-disclosed application

FIELD OF THE INVENTION

The present invention relates to a deployable assembly for antennae, mainly used in space systems, particularly to a deployable assembly to deploy large parabolic reflectors. The assembly is suitable for multiple purposes not only to deploy large reflectors but also to build large antennas for Earth observation and telecom, to build foldable clusters of satellites and even to build space debris capture systems.

BACKGROUND

There are many deployable reflector antenna structures already known in the state of the art.

U.S. Pat. No. 4,030,102 A, referred to a "Deployable reflector structure", discloses a supporting structure that deployed resembles a spoked wheel which is retractable into a compact volume by virtue of hinged rim and reelable spokes that is an efficient and stable structure for storing, deploying and supporting surfaces such as radar and communications antennas, shielding, earth sensing, solar cell arrays and solar energy reflectors.

U.S. Pat. No. 3,617,113 A discloses a deployable reflector assembly comprising a deployable reflector, a series of deployable panels surrounding and operatively connected to said deployable reflector, said series of deployable panels comprising a first deployable array of panels interconnected to form substantially an open cylinder upon deployment and a second deployable array of panels operatively connected to said first deployable array of panels, said second array of panels being interconnected to form a substantially flat ring upon being deployed that lies in a plane that is substantially perpendicular to the central axis of said cylinder formed by said deployed first array of panels and deploying means operatively connected to said series of deployable panels for deploying said series of deployable panels.

WO 2009153454 A2 discloses a hinged folding structure consisting of an assembly of elements hinged together by hinge means, where each of the elements has at each end a hinge enabling it to be connected to the end of another element across a hinge axis (X, Y), all the pivot pins of the hinges being so constructed that the structure can adopt two extreme positions, namely an unfolded position where the elements are more or less continuous with each other to form an ellipse, and a folded position where the elements are brought together and approximately parallel with each other. The elements and the hinges are connected both to means for controlling the unfolding of the elements, and to assistance means for ensuring simultaneity of the unfolding or folding of the elements.

EP 2482378 A1 discloses a deployable antenna which has a larger aperture diameter by four-side links provided in at least three stages and which includes: six deployment link mechanisms arranged radially from a central shaft so as to support an outer edge portion of a flexible reflector mirror surface; and one deployment driving mechanism arranged at a lower portion of a center of arrangement of the six deployment link mechanisms, for unfolding the six deployment link mechanisms. Each of the six deployment link mechanisms includes a first four-side link, a second four-side link, and a third four-side link arranged in an order from a position of the central shaft, around which the six deployment link mechanisms are arranged, toward an outer side of the each of the six deployment link mechanisms so that the each of the six deployment link mechanisms is structured to be foldable in three stages.

WO 2013135298 A1 discloses a mechanical support ring structure for supporting a deployable space reflector antenna. The mechanical support ring structure is convertible from a folded state into a deployed state and comprises a ring-shaped pantograph having a plurality of circumferentially arranged pantograph sections which are deployable for converting the mechanical support ring structure from the folded state into the deployed state, and a plurality of circumferentially arranged support rods, each pantograph section being arranged between a respective pair of support rods, wherein each pantograph section comprises one or more pairs of pantograph rods which intersect crosswise with each other at a respective crossing position.

EP 2768077 A1 discloses a space deployable structure able to change from a substantially cylindrical configuration into a substantially planar polygonal configuration having n sides, comprising: n pairs of segments, each pair of segments being formed by two single segments, forming one side of the polygon of the deployed structure, such that the single segments have a lower base substantially vertical having a prismatic shape, the segments being substantially symmetric between them with respect to the mentioned lower base, having their longest direction parallel to the side of the polygon formed in the deployed configuration of the structure; 2n joints that join the segments between them by their extremes; and a deployment system based in the simultaneous folding of all of the segments forming the structure with respect to their contiguous segments, over the corresponding joints, in such a way that the hinge axis and the cone axis stay parallel to the plane of the polygon in deployed configuration, the deployment angles being always kept the same between the same type of joints.

These prior art configurations provide deployable structures able to work satisfactorily. However, they have some drawbacks, like the high number of devices necessary to keep the structure folded during launch, the high number of articulations and moving assemblies and the very limited number of flight configurations and applications.

SUMMARY OF THE INVENTION

Thus, it is an object of the invention to provide a deployable assembly for reflectors used in space systems that is able to overcome the mentioned drawbacks.

The invention provides a deployable assembly for antennae, comprising:

- a structure comprising:
  - n pairs of segments, each pair of segments corresponding to one side of a deployed polygonal shape,
  - n hinge joints between the two segments of a side, and
  - n hinged angular links between every two adjacent sides,
- such that the structure is configured to change from a stowed position with a substantially cylindrical shape into a deployed position with a substantially planar polygonal shape with n sides, and
- a reflective surface,
- that additionally comprises:
- a deployable boom between two segments, wherein the deployable boom lays stowed between the two segments in the stowed position, a feeder on an end of the deployable boom (3), the feeder being configured to electromagnetically feed the antenna and that comprises a clamping element for keeping the structure closed when stowed, such that the feeder plays the role of structural support element when stowed and electromagnetic feeder for the antenna when deployed, a set of tensor elements protruding from the back of the segments, and a cable network that can shape the reflective surface, such that the corresponding cables are held by the tensor elements.

The main advantages of the configuration of the invention versus the known configurations are:

Simplified geometric configuration for a deployable parabolic reflector.

It provides a reduced volume of the stowed assembly in the launch configuration, compatible with existing launchers whilst maximizing aperture ratio.

It allows accommodating within segments of the hexagonal structure, some of the subsystems of the platform, ultimately arriving at a design in which all subsystems of the satellite platform and the instrument are included in the hexagonal structure.

Stable structure despite its size, which ensures that errors due for example to fluctuations caused by satellite maneuvers, are minimum.

Large sections of the segments and joints of hinges and cones allowing to obtain high angular precision between the segments in the deployed configuration.

Ability to meet easily a wide range of performances with minor modifications in the system (larger reflector's diameter can be met varying just the length of the segments, and circular to elliptical reflector contour can be achieved varying just the angles among the segments).

Kinematics of the segments during deployment makes their centers of gravity follow a lineal straight pattern, easing the validation by test with a gravity compensation device. The global center of mass does not move during deployment, they can be fixed or deployable.

Feeder structural support is an integral part of the stowed structure and, when the invention is deployed and used as a reflector antenna, it plays the role of feeder in the focal position.

Placing everything away from the FoV of the instrument, behind the reflector to enhance mission performances.

Guarantee the accuracy of the reflecting deployable surface with respect to the target paraboloid.

It provides the optimal geometric configuration for an interferometric radiometer improving radio frequency interference (RFI) and resolution and reducing noise.

The deployable assembly of the invention provides superior performance to those found to date in conventional systems known in the art.

Two clamping mechanisms (could be clamp bands) hold the folded assembly during launch and till deployment.

The folded assembly is very compact and robust, enabling a small size of the system inside the launcher available volume.

The design of the deployed structure can be easily accommodated to different sizes for bigger or smaller reflectors and satellites.

Although description is made for a hexagonal configuration, it can be adapted to a different number of sides.

This structure is suitable for multiple purposes, not only to deploy large reflectors but also to build large antennas for Earth observation and telecom, build clusters of foldable satellites coordinated and launched together and even build space debris capture systems.

The deployable structure of the invention is also self-supporting, so no auxiliary elements are needed in order to obtain stiffness, guidance and shape during deployment.

Other features and advantages of the present invention will become apparent from the following detailed description of an illustrative embodiment and not limiting its purpose in connection with the accompanying figures.

DETAILED DESCRIPTION OF THE INVENTION

Figure 1:
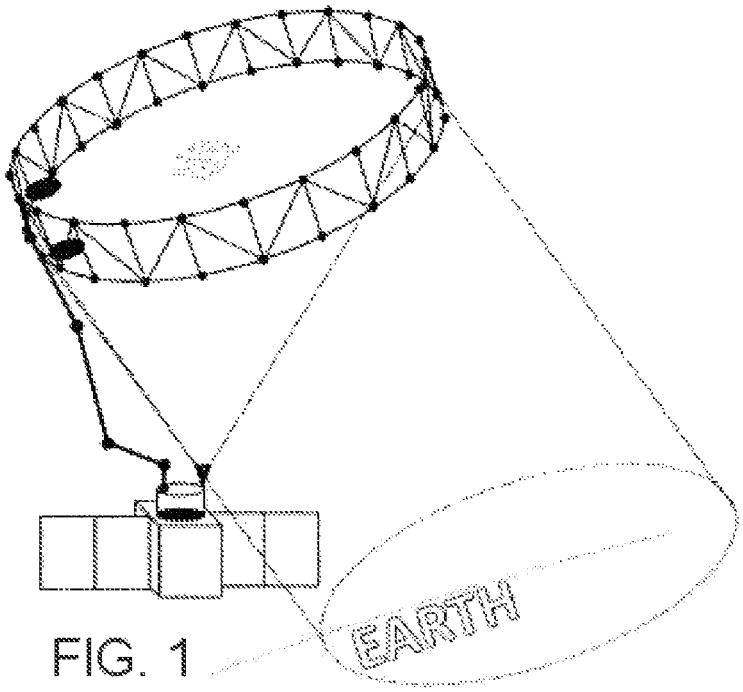
FIG. 1 PRIOR ART
FIG. 1 is an isometric view of a prior art large deployable reflector attached to a satellite.
Figure 2A:
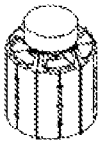
FIGS. 2A, 2B and 2C are schematic overviews of the object of the invention in the stowed, deploying and fully deployed (operative) positions, respectively.
Figure 2B:
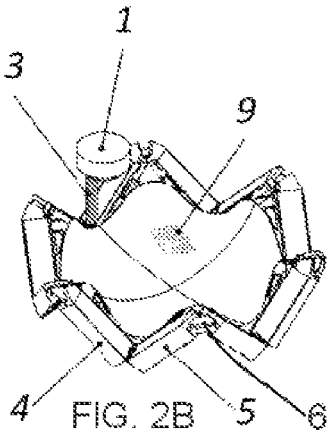
Figure 2C:
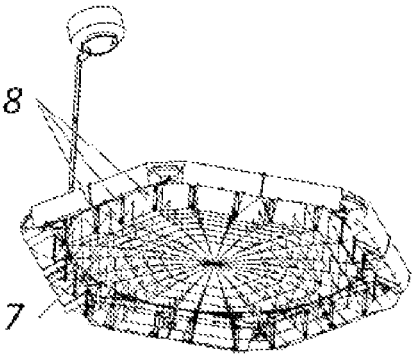

FIGS. 2A, 2B and 2C show the deployable assembly for antennae of the invention in several stages. FIG. 2A shows the stowed position, FIG. 2B shows an intermediate position in which the assembly is being deployed, and FIG. 2C shows the fully deployed position.

FIGS. 6A to 6F also show the deployable assembly for antennae of the invention in several stages, with more intermediate positions.

Figure 7:
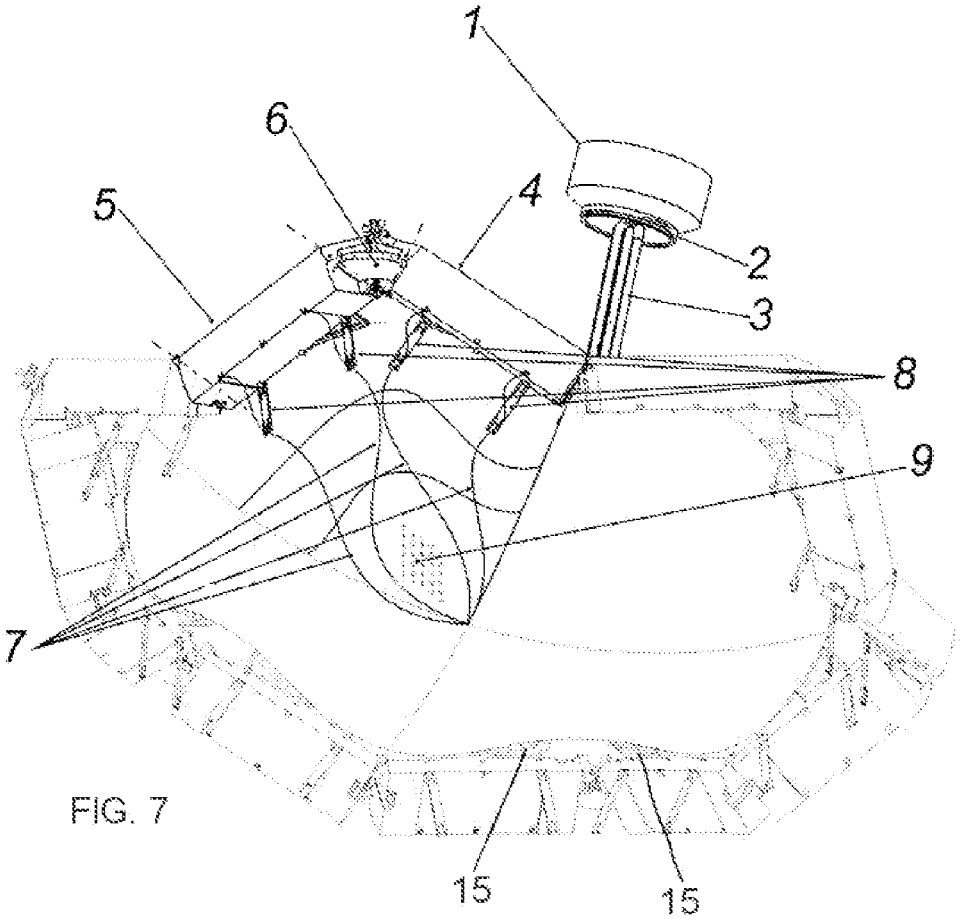
FIG. 7 shows the deployable assembly of the invention in an intermediate position of the deployment process.

FIG. 7 is a detailed view of the deployable assembly of the invention in an intermediate position of the deployment process, in which all of its elements can be seen.

The deployable assembly for antennae shown in these figures comprises:

a structure comprising:

n pairs of segments 4, 5, each pair of segments 4, 5 corresponding to one side of a deployed polygonal shape, n hinge joints between the two segments 4, 5 of a side, and hinged angular links 6 between every two adjacent sides, and a reflective surface 9.

Figure 5:
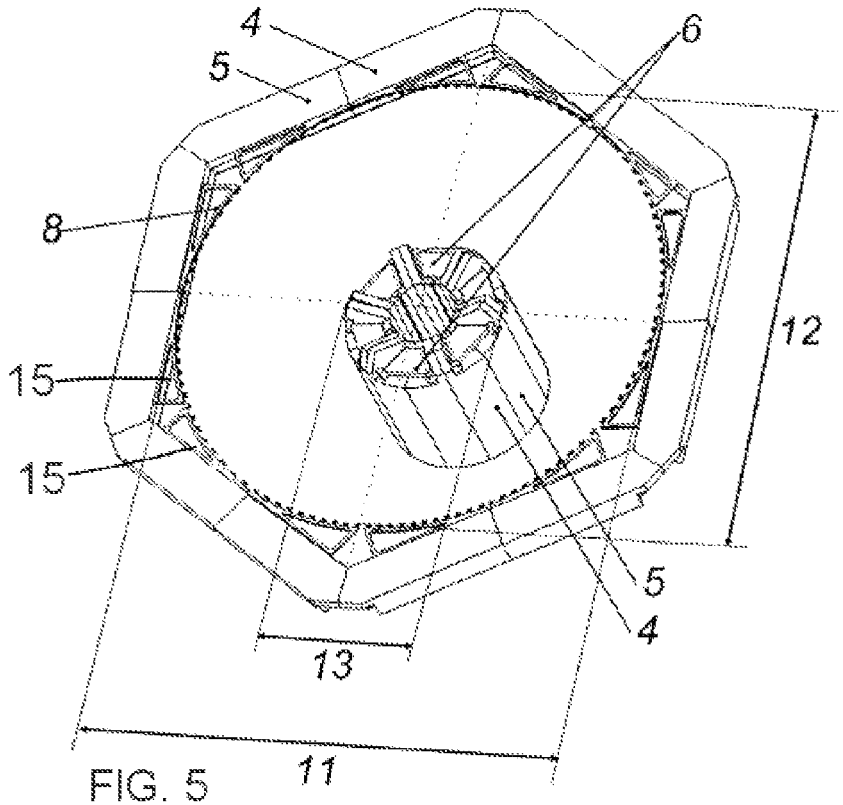
FIG. 5 is a simplified view of the stowed and the deployed assembly (feeder, boom, cable network and reflective surface not represented).

The structure is configured to change from a stowed position with a substantially cylindrical shape into a deployed position with a substantially planar polygonal shape with n sides, as it can be seen in FIG. 5.

The deployable assembly for antennae also comprises:

a deployable boom 3 between two segments 4, 5, wherein the deployable boom 3 lays stowed between the two segments 4, 5 in the stowed position, a feeder 1 on an end of the deployable boom 3, the feeder 1 being configured to electromagnetically feed the antenna and that comprises a clamping element 2 for keeping the structure closed when stowed, such that the feeder 1 plays the role of structural support element when stowed and electromagnetic feeder for the antenna when deployed, a set of tensor elements 8 protruding from the back of the segments 4, 5, and a cable network 7 that can shape the reflective surface 9, such that the corresponding cables are held by the tensor elements 8.

Figure 6A:
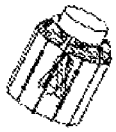
FIGS. 6A to 6F show the main steps of the deployment of the structure and the assembly.
Figure 6B:
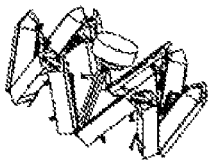
Figure 6C:
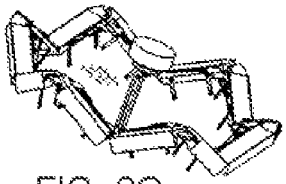
Figure 6D:
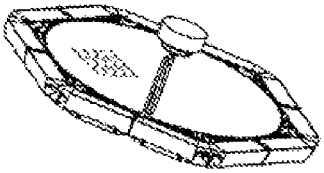
Figure 6E:
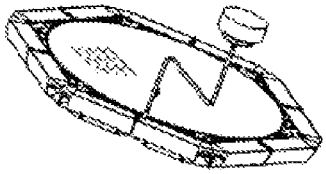
Figure 6F:
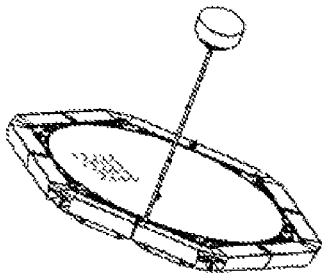

Preferably, the deployable boom 3 is placed between two segments 4, 5 of the same side of the polygonal shape, as it can be seen, for instance, in FIGS. 6B to 6F. The deployable boom 3 lies stowed, clamped and protected between two segments 4,5 before being deployed to meet the focal distance. FIGS. 6A to 6D show the successive steps for the formation of the polygonal shape with n sides, and FIGS. 6D to 6F show the deployment of the boom 3. In FIG. 6F the deployable assembly for antennae of the invention is completely deployed.

FIG. 5 is a simplified view of the deployable assembly of the invention mainly showing the structure, where the feeder 1, the boom 3, the cable network 7 and reflective surface 9 are not represented.

As indicated, the feeder 1 can play the role of:

a fixation element for the segments 4,5 when stowed, by means of the clamping element 2 (see FIG. 3, for example), and an electromagnetic feeder for the antenna, when the feeder 1 is deployed.

The clamping element 2 can be, for instance, a clamp band similar to the ones used in similar applications in spacecraft systems.

The deployed polygonal shape has n sides, corresponding to the n pairs of segments 4, 5. In the figures that show an embodiment of the invention a hexagonal shape has been chosen (see, for example, FIG. 5). Each pair of segments is formed by two symmetric segments 4, 5, with a hinge joint as a linking element between them.

The deployable ring structure of the invention has enough room inside to hold the necessary spacecraft subsystems. It may contain everything needed to form a complete satellite, like power systems, flight and attitude control and communication with the Earth, though it can also be conceived as a payload, attached to a bigger satellite.

FIGS. 5 and 7 also show n hinged angular links 6 between every two adjacent sides of the polygonal shape, thus placed in each corner of the polygonal shape. The shape can be defined as a regular or non-regular polygon, in order to achieve a circular or elliptical contour of the reflective surface 9. FIGS. 5 and 7 also show a set of brackets 15 protruding from the back of the segments 4, 5 to shape the contour of the reflective surface 9.

The movement of the deployment of the structure is achieved by motors at each hinged angular link 6. The coordination can be guaranteed by mechanical means and/or position sensors as feedback signals when needed. The final position can be guaranteed by end-stops, and the non-reversibility of the final deployed configuration can be ensured with latches, if wished.

The cable network 7 comprises several tensioning cables to ensure that the reflective surface 9 meets its desired shape when deployed. As it can be seen in FIG. 7, the tensioning cables can be held by tensor elements 8 protruding from the back of the segments 4, 5, able of tensing the tensioning cables.

By means of this configuration a tensioned cable network 7 is obtained. Preferably the reflective surface 9 is a paraboloid formed by cables that work by traction, as previously described.

As for the contour of the reflective surface 9, it can be circular or elliptical.

Figure 3:
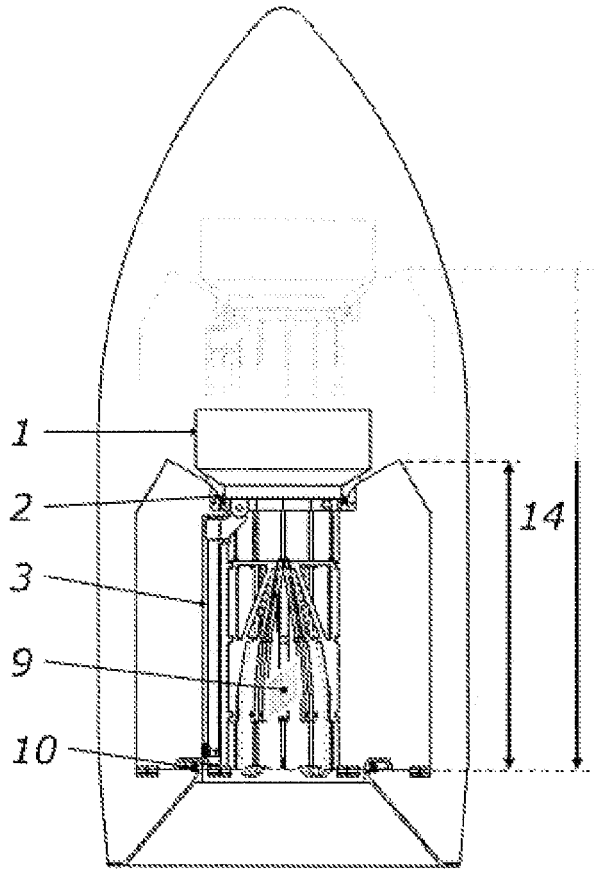
FIG. 3 is a more detailed view of the stowed assembly, in the launch configuration within the available volume of the fairing.
Figure 4:
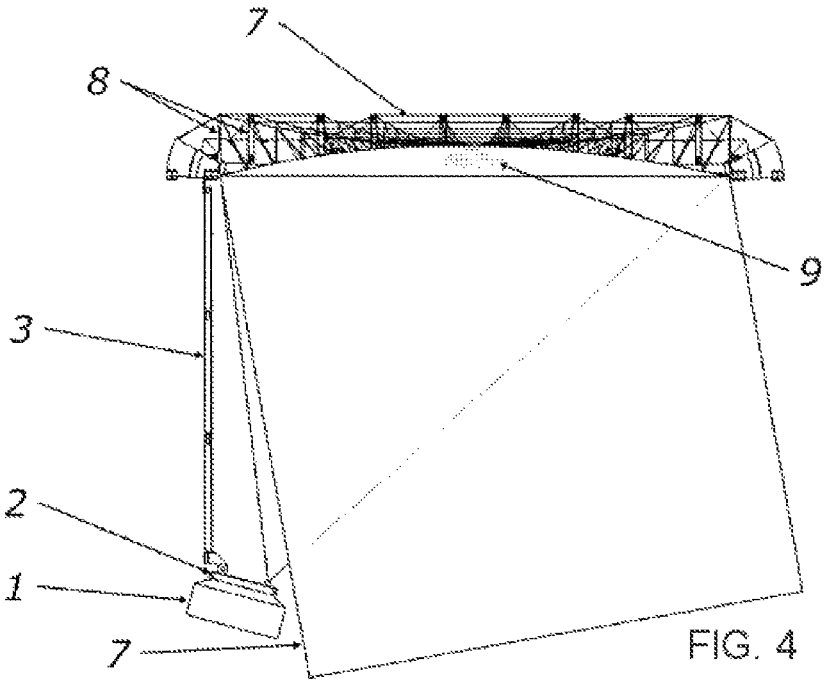
FIG. 4 shows the deployed assembly in the operative arrangement.

The reflective surface 9 is folded, constrained and protected inside the stowed structure during launch (see FIGS. 3 and 6A). The stowed structure protects the reflective surface 9 from contacting and damaging the feeder 1.

FIG. 3 also shows a lower clamping element 10 (for instance, a clamp band) that stays with the launcher after separation. It also shows the available stowed height range 14 within the launcher, which defines the diameter of the reflective surface 9.

FIG. 5 also shows the minor axis 11 and the major axis 12 of the contour of the reflective surface 9 when it is elliptical. It also shows the diameter 13 of the structure in the stowed position.

The present invention represents a space closed loop deployable assembly with a structure able to change from a substantially cylindrical configuration into a substantially planar polygonal configuration having n sides:

Holding tightly all the systems from launch till deployment, with the need of just two clamping elements 2, 10 (could be clamp bands).

Deploying a wide range of reflector antennae, maintaining the same minimum amount of mechanisms.

Accommodating all the systems traditionally contained in a service module (such as propulsion, power generation, navigation, etc) inside its deployable segments.

Easing the design, analysis, manufacturing and Assembly Integration & Testing (AIT) tasks.

Suitable for multiple purposes:

Earth observation (Large Deployable Reflectors, radiometers, radars)

Telecom

Space debris capture

Cluster of coordinated satellites launched together to reduce costs and sub-sequent space debris at the end of life.

Building segments for larger space structures assembled in space

Although the present invention has been fully described in connection with preferred embodiments, it is apparent that modifications can be made within the scope, not considering this as limited by these embodiments, but by the content of the following claims.

The invention claimed is:

1. A deployable assembly for antennae, comprising:

a structure comprising:

n pairs of segments, each pair of segments corresponding to one side of a deployed polygonal shape, n hinge joints between the two segments of a side, and n hinged angular links between every two adjacent sides, wherein the structure is configured to change from a stowed position with a substantially cylindrical shape into a deployed position with a substantially planar polygonal shape with n sides, and a reflective surface, a deployable boom between two segments, wherein the deployable boom lays stowed between the two segments in the stowed position, a feeder on an end of the deployable boom, the feeder being configured to electromagnetically feed the antenna and comprises a clamping element for keeping the structure closed when stowed, wherein the feeder acts as a structural support element when stowed and electromagnetic feeder for the antenna when deployed, a set of tensor elements protruding from a back of the segments, and a cable network configured to shape the reflective surface, wherein the corresponding cables are held by the tensor elements.

2. A deployable assembly for antennae, according to claim 1, wherein the reflective surface is a paraboloid with circular contour.

3. A deployable assembly for antennae, according to claim 1, wherein the reflective surface is a paraboloid with elliptical contour.

4. A deployable assembly for antennae, according to claim 1, further comprising a set of brackets protruding from the back of the segments to shape the contour of the reflective surface.

5. A deployable assembly for antennae, according to claim 1, further comprising a lower clamping element.

6. A deployable assembly for antennae, according to claim 1, wherein the deployable boom is placed between two segments of a same side of the polygonal shape.

7. A deployable assembly for antennae, according to claim 1, further comprising motors at each hinged angular link between every two adjacent sides.

8. A deployable assembly for antennae, according to claim 1, further comprising latches to ensure non-reversibility of a final deployed position.

* * * * *